US008474087B1

(12) United States Patent
Butler

(10) Patent No.: US 8,474,087 B1
(45) Date of Patent: Jul. 2, 2013

(54) SANDPAPER CLEANER

(75) Inventor: David J Butler, Erie, PA (US)

(73) Assignee: D³VDesign LLC, Erie, PA (US)

( * ) Notice: Subject to any disclaimer, the term of this patent is extended or adjusted under 35 U.S.C. 154(b) by 370 days.

(21) Appl. No.: 12/798,816

(22) Filed: Apr. 12, 2010

(51) Int. Cl.
*A47L 13/10* (2006.01)

(52) U.S. Cl.
USPC ..... 15/227; 15/104.002

(58) Field of Classification Search
USPC ..... 15/104.002, 227
See application file for complete search history.

(56) References Cited

U.S. PATENT DOCUMENTS 2,256,098 A * 9/1941 Mauldin ..... 451/516
2,811,767 A * 11/1957 Dufford ..... 425/470
5,094,559 A * 3/1992 Rivera et al. ..... 401/132
5,327,688 A * 7/1994 Norkus ..... 451/539
6,003,190 A * 12/1999 Knudsen ..... 15/210.1
7,484,261 B2 * 2/2009 Sigl et al. ..... 15/104.94
7,823,245 B2 * 11/2010 Firouzman ..... 15/227
2003/0005535 A1 * 1/2003 Hale ..... 15/209.1
2003/0145408 A1 * 8/2003 Kohlruss et al. ..... 15/209.1
2006/0230559 A1 * 10/2006 Knopow et al. ..... 15/104.002
2006/0242780 A1 * 11/2006 Yang et al. ..... 15/227

* cited by examiner

*Primary Examiner* — Brian Glessner
*Assistant Examiner* — Adriana Figueroa
(74) *Attorney, Agent, or Firm* — Richard K Thomson

(57) ABSTRACT

A first base layer includes capability to attach the sandpaper cleaner to an appendage of the user, either elastic memory in the first embodiment, a pocket allowing the device to be worn on the hand as a mitt or, alternatively, belt-receiving slots or a protrudable flap for insertion into a user's pocket. A second layer is bonded to the upper surface of the first and features a material such as flocked foam for clearing accumulated particulate from the grit of the abrasive of the sandpaper.

1 Claim, 2 Drawing Sheets

SANDPAPER CLEANER

BACKGROUND AND SUMMARY OF THE INVENTION

The present invention is directed to the field of surface preparation. More particularly, the present invention is directed to a body-worn sandpaper cleaner for extending the useful life of all grades of sandpaper, from emery cloth to coarse sandpaper.

In industries extending from automobile repair/refinishing to airplane and boat finishing to clay, metal, plastic, and wood working/modeling, a common problem is clogging of the sandpaper. Regardless of the grade of the abrasive bonded to a backing sheet, the sandpaper typically clogs with particles before the abrasive detaches from the backing sheet; that is, the sandpaper clogs before it wears out, significantly shortening its useful life and increasing the cost of the project.

The present invention is directed to apparatus for cleaning waste particles out of the abrasive to refresh the sandpaper to allow its useful life to be significantly extended. Specifically the invention is comprised of apparatus for cleaning all grades of abrasive material bonded to a backing material, to extend its useful life, the apparatus including a) a first base layer; b) means to attach the base layer to a portion of a person's anatomy; c) a second layer attached to an upper surface of the base layer, the second layer being a cleaning material for clearing the abrasive of accumulated particles. This layer, while it may include microfiber, terry cloth, bristles, or the like, most preferably, is made of flocked foam. The means to attach the base layer to a portion of a person's anatomy may include belt-receiving slots; a protrudable flap receivable in a user's pocket; or an elastic memory of the base layer which permits the first layer to be wrapped around an appendage of an user.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
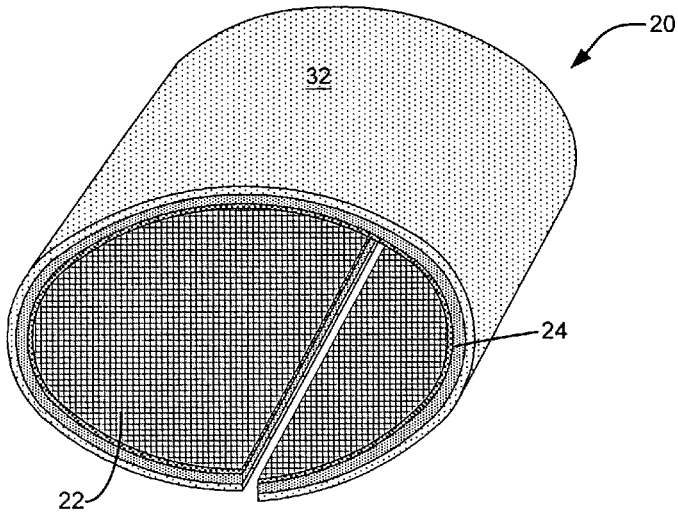
FIG. 1 is a perspective end view of a first embodiment of the of the present invention.

A first embodiment of the body-supported sandpaper cleaner of the present invention is depicted in FIG. 1 generally at 20. Sandpaper cleaner 20 includes a first base layer 22. Each of the embodiments includes means to attach first base layer 22 to a portion of a person's anatomy such as an arm, a hand, or a leg. In this first embodiment, the attachment means comprises an elastic memory of first base layer 22 which permits first base layer 22 to be wrapped around an appendage of an user. Cleaner 20 is sized to fit around the forearm of a user but may be expanded to encompass a user's biceps or thigh. Second layer 32, which is a cleaning material for clearing the abrasive of accumulated particles, is attached to an upper surface 24 of first base layer 22 as by bonding with an adhesive, for example. While second layer 32 could conceivably be a microfiber, terry cloth or even bristles, layer 32 is preferably a flocked foam. Flocked foam has been demonstrated to be highly effective in clearing accumulated particles from all grades of abrasive sheets, from emery cloth to coarse grade sandpaper.

Figure 2:
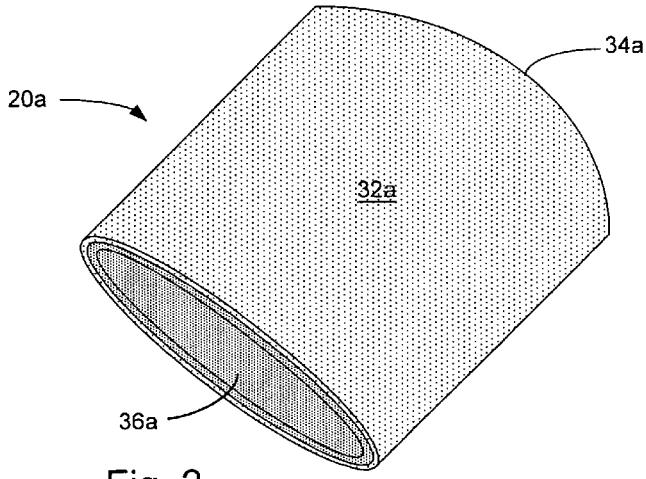
FIG. 2 is a perspective front view of a second embodiment.

A second embodiment is depicted in FIG. 2 generally at 20*a*. This embodiment is constructed as a flat pocket which can be worn as a mitt or glove. One end is sewn or glued to form bottom 34*a* while opposite end 36*a* is open to receive a user's hand. This cleaner mitt 20*a*, in addition to clearing accumulated particles from abrasive sheets while worn on the non-sanding hand, can be used to remove particulate from the surface being sanded by buffing with either of the user's hands.

Figure 3:
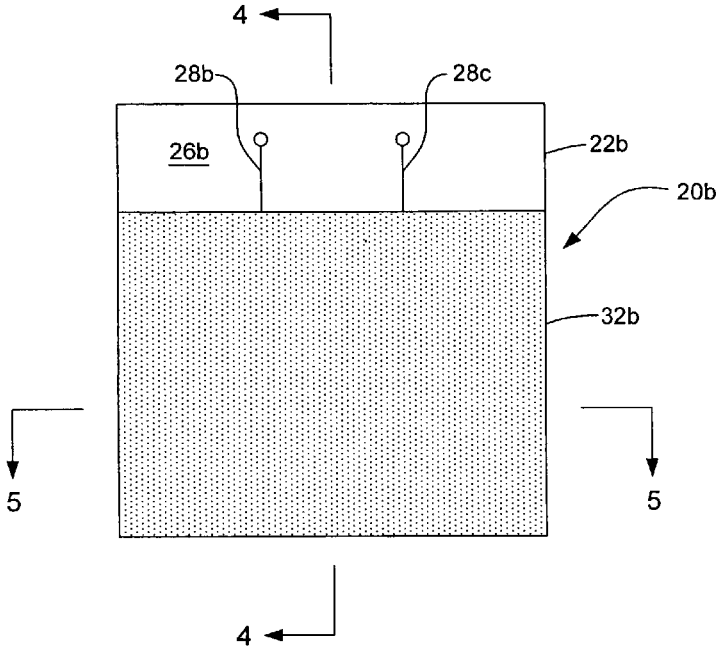
FIG. 3 is a top view of a third embodiment.
Figure 5:
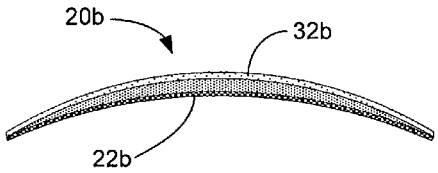
Figure 4:
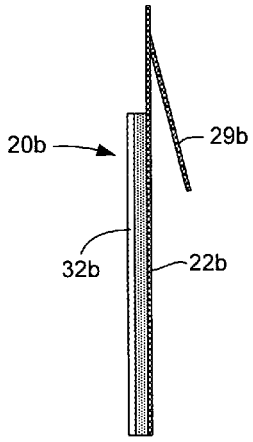
FIG. 4 is a cross-sectional side view of the third embodiment taken along line 4-4 of FIG. 3; and, FIG. 5 is a cross-sectional end view of the third embodiment taken along line 5-5 of FIG. 3.

A third embodiment is depicted in FIGS. 3-5 generally at 20*b*. In this embodiment, base layer 22*b* has a gentile camber to it, side to side (FIG. 5). Upper edge portion 26*b* of base layer 22*b* is devoid of second layer and has a pair of belt-receiving slots 28*b* and 28*c* for permitting cleaner 20*b* to be readily mounted to the belt of a user. In addition, a flap 29*b* extending between slots 28*b* and 28*c* may be pushed laterally outwardly so as to protrude (FIG. 4) to permit its insertion into a user's pocket.

In use, sandpaper cleaner 20, 20*a*, 20*b* may be attached to a portion of the user's anatomy such as a left forearm, a right thigh using the elastic memory of the first embodiment, the non-sanding hand of the user in the second embodiment, or the belt-receiving slots 28*b*, 28*c* or protrudable flap 29*b* of the third embodiment. When the abrasive of the sandpaper becomes loaded with accumulated particles, the user may simply drag the sandpaper over the surface of the second layer 32, 32*a*, 32*b* to dislodge the particles restoring the sandpaper to its original usefulness.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. Apparatus for cleaning all grades of abrasive bonded to a backing material, to extend its useful life, said apparatus comprising:

a thin, rectangular article including a) a first base layer, an upper surface of said base layer defining a first plane;

b) means to attach said base layer to a portion of a person's anatomy, said means to attach including a pair of parallel slots extending through said base layer interconnected by a transverse slit whereby a tab having three sides defined by said pair of parallel slots and said transverse slit may function both by remaining in said first plane and be captured by a wearer's belt looped through said pair of parallel slots and, alternatively, said tab may be pushed out of plane below said first plane and inserted into a wearer's pocket;

c) a second layer attached to an upper surface of said base layer, said second layer being a cleaning layer formed of flocked foam for clearing the abrasive of accumulated particles.

* * * * *